US010322601B2

(12) United States Patent
Mengel et al.

(10) Patent No.: US 10,322,601 B2
(45) Date of Patent: Jun. 18, 2019

(54) SECURITY ELEMENT WITH EFFECT PIGMENTS AND AN EMBOSSING STRUCTURE AND METHOD FOR THE PRODUCTION THEREOF

(71) Applicant: GIESECKE+DEVRIENT CURRENCY TECHNOLOGY GMBH, München (DE)

(72) Inventors: Christoph Mengel, Holzkirchen (DE); Peter Franz, Pienzenau/Bruck (DE); Thanh-Hao Huynh, Bruckmühl (DE); Karlheinz Mayer, Grünenbach (DE); Christian Fuhse, Otterfing (DE); Stefan Bichlmeier, Riemerling (DE); Matthias Pfeiffer, München (DE); Christof Baldus, München (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 119 days.

(21) Appl. No.: 15/562,214

(22) PCT Filed: Jan. 13, 2016

(86) PCT No.: PCT/EP2016/000051
§ 371 (c)(1),
(2) Date: Sep. 27, 2017

(87) PCT Pub. No.: WO2016/155859
PCT Pub. Date: Oct. 6, 2016

(65) Prior Publication Data

US 2018/0117946 A1 May 3, 2018

(30) Foreign Application Priority Data

Mar. 27, 2015 (DE) ..... 10 2015 004 027

(51) Int. Cl.
*B42D 15/00* (2006.01)
*B41M 3/14* (2006.01)
(Continued)

(52) U.S. Cl.
CPC ..... *B42D 25/324* (2014.10); *B41M 1/04* (2013.01); *B41M 1/10* (2013.01); *B41M 1/12* (2013.01);
(Continued)

(58) Field of Classification Search
CPC .... B42D 25/328; B42D 25/29; B42D 25/324; B42D 25/425; B42D 25/373
See application file for complete search history.

(56) References Cited

U.S. PATENT DOCUMENTS 8,333,870 B2 12/2012 Burchard et al.
8,964,296 B2 * 2/2015 Hoffmuller ..... B44C 1/1737 359/618
(Continued)

FOREIGN PATENT DOCUMENTS

DE 10243653 A9 11/2006
DE 102010053052 A1 6/2012
(Continued)

OTHER PUBLICATIONS

International Preliminary Report on Patentability from PCT Application No. PCT/EP2016/000051, dated Oct. 3, 2017.
(Continued)

*Primary Examiner* — Shin H Kim
(74) *Attorney, Agent, or Firm* — Workman Nydegger

(57) ABSTRACT

A value and safety document comprises a substrate having a front side and a back side. An ink layer is applied to the front or back sides of the substrate. A first motif is incorporated into the ink layer, and is combined with a second motif. The second motif is arranged on the same side of the
(Continued)

substrate as the first motif. The second motif is configured in the form of an emboss structure comprising a plurality of raised emboss elements having areas of different orientation. The emboss structure forms the second motif having a second tilt or motion effect, by different groups of emboss elements, having different characteristic parameters, reflecting incident light in different spatial areas. The emboss elements have respectively a lateral dimension of less than 30 μm and a height of less than 10 μm. The first motif is adapted at least partially to the second motif.

12 Claims, 2 Drawing Sheets

(51) Int. Cl.

| | |
|---|---|
| ***B42D 25/324*** | (2014.01) |
| ***B42D 25/351*** | (2014.01) |
| ***B42D 25/355*** | (2014.01) |
| ***B42D 25/373*** | (2014.01) |
| ***B42D 25/378*** | (2014.01) |
| ***B42D 25/425*** | (2014.01) |
| ***B41M 1/04*** | (2006.01) |
| ***B41M 1/10*** | (2006.01) |
| ***B41M 1/12*** | (2006.01) |
| *B42D 25/23* | (2014.01) |
| *B42D 25/24* | (2014.01) |
| *B42D 25/29* | (2014.01) |
| *B42D 25/309* | (2014.01) |
| *B42D 25/364* | (2014.01) |

(52) U.S. Cl.

CPC ..... *B41M 3/148* (2013.01); *B42D 25/351* (2014.10); *B42D 25/355* (2014.10); *B42D 25/373* (2014.10); *B42D 25/378* (2014.10); *B42D 25/425* (2014.10); *B42D 25/23* (2014.10); *B42D 25/24* (2014.10); *B42D 25/29* (2014.10); *B42D 25/309* (2014.10); *B42D 25/364* (2014.10)

(56) References Cited

U.S. PATENT DOCUMENTS

| | | | | |
|---|---|---|---|---|
| 9,415,622 | B2 | 8/2016 | Heim | |
| 9,598,821 | B2 * | 3/2017 | Schaede | B32B 27/10 |
| 9,669,647 | B2 | 6/2017 | Mayer et al. | |
| 9,840,071 | B2 * | 12/2017 | Hoffmuller | B42D 25/29 |
| 9,947,711 | B2 * | 4/2018 | Minixhofer | H01L 27/14618 |
| 2006/0127649 | A1 | 6/2006 | Keller et al. | |
| 2006/0285184 | A1 * | 12/2006 | Phillips | B41M 3/14 359/2 |
| 2008/0258456 | A1 | 10/2008 | Rahm et al. | |
| 2010/0230615 | A1 * | 9/2010 | MacPherson | G03H 1/0256 250/488.1 |
| 2011/0101670 | A1 | 5/2011 | Heim | |
| 2012/0068450 | A1 * | 3/2012 | MacPherson | G07D 7/003 283/70 |
| 2013/0063826 | A1 * | 3/2013 | Hoffmuller | B44C 1/1737 359/619 |
| 2013/0099474 | A1 * | 4/2013 | Fuhse | B42D 15/00 283/85 |
| 2014/0232100 | A1 | 8/2014 | Mayer et al. | |
| 2014/0329172 | A1 * | 11/2014 | Hart | G03H 1/04 430/2 |
| 2015/0061280 | A1 * | 3/2015 | Power | G02B 5/1828 283/85 |
| 2015/0258838 | A1 | 9/2015 | Fuhse | |
| 2015/0298482 | A1 * | 10/2015 | Walter | G02B 5/008 359/572 |
| 2016/0147076 | A1 * | 5/2016 | Rich | B42D 25/324 359/478 |
| 2017/0129272 | A1 * | 5/2017 | Rich | G02B 5/18 |
| 2017/0165997 | A1 * | 6/2017 | Holmes | B42D 25/425 |
| 2017/0217242 | A1 * | 8/2017 | Lochbihler | G02B 5/1842 |
| 2018/0001692 | A1 * | 1/2018 | Rich | B32B 7/06 |
| 2018/0043724 | A1 * | 2/2018 | Hardwick | B42D 25/328 |
| 2018/0117946 | A1 * | 5/2018 | Mengel | B42D 25/324 |
| 2018/0201043 | A1 * | 7/2018 | Walter | G02B 5/008 |
| 2018/0247478 | A1 * | 8/2018 | Lee | G07D 7/06 |

FOREIGN PATENT DOCUMENTS

| | | | |
|---|---|---|---|
| EP | 2608964 | A2 | 7/2013 |
| WO | 2007079851 | A1 | 7/2007 |
| WO | 2009149831 | A2 | 12/2009 |
| WO | 2012025206 | A2 | 3/2012 |
| WO | 2013045055 | A1 | 4/2013 |
| WO | 2014060089 | A2 | 4/2014 |

OTHER PUBLICATIONS

International Search Report from PCT Application No. PCT/EP2016/000051, dated Mar. 23, 2016.

* cited by examiner

SECURITY ELEMENT WITH EFFECT PIGMENTS AND AN EMBOSSING STRUCTURE AND METHOD FOR THE PRODUCTION THEREOF

BACKGROUND

The invention relates to a value and safety document which consists of a substrate having a front side and a back side, wherein an ink layer is applied to the front side or back side of the substrate. A first motif in the form of a pattern, symbol or coding is incorporated into the ink layer. Here, the first motif is configured in the form of an emboss structure which consists of a plurality of raised emboss elements having areas of different orientation which are characterized by the parameters size, outline form, relief form, reflectivity and spatial alignment. Upon tilting the value and security document, this emboss structure shows a first tilt or motion effect, by at least two different groups of emboss elements, having different characteristic parameters, reflecting incident light in different spatial areas. The emboss elements have respectively a lateral dimension of more than 30 μm and a height of more than 10 μm. The invention further relates to a method for producing a corresponding value and security document.

A generic value and security document is known, for example, from EP 2608964 A2.

Value and security documents, such as for example bank notes, value documents or identity documents, but also other objects of value, such as branded articles for instance, are often provided for safeguarding purposes with security elements which permit a verification of the authenticity of the data carrier and which at the same time serve as protection from unauthorized reproduction. The security elements can be configured, for example, in the form of a safety thread embedded in a bank note, a cover foil for a bank note with hole, an applied security strip, a self-supporting transfer element or also in the form of a feature region directly applied to a value document.

A special role in authentication assurance is played by security elements with viewing angle-dependent visual effects, because these cannot be reproduced even with the most modern copiers. For this purpose, effect pigments are also used which for different viewing angles show different representations and therefore a tilt effect.

SUMMARY

The invention is based on the object of developing a generic value and security element so as to further increase the protection from forgeries.

According to the invention, the first motif is combined with a second motif in the form of a pattern, symbol or coding, wherein the second motif is arranged on the same side of the substrate as the first motif. Here, the second motif is configured in the form of an emboss structure which consists of a plurality of raised emboss elements having areas of different orientation which are characterized by the parameters size, outline form, relief form, reflectivity and spatial alignment. The emboss structure forms the second motif having a second tilt or motion effect, by different groups of emboss elements, having different characteristic parameters, reflecting incident light in different spatial areas. Here, the emboss elements have respectively a lateral dimension of less than 30 μm and a height of less than 10 μm. Additionally the pattern, the symbol or the coding of the first motif is adapted at least partially to the pattern, the symbol or the coding of the second motif.

An emboss structure with emboss elements in the form of micromirrors which have respectively a lateral dimension of less than 30 μm and a height of less than 10 μm is known from WO 2007/079851 A1. Here, a combination is described of an achromatic reflection of electromagnetic radiation, in particular light, on micromirrors and a chromophore interference structure (so-called "color shift") arranged on the surface of these micromirrors.

The value of attention and recognition, and therefore the anti-forgery security of the value and security document, is increased distinctly by the combination of a first motif having a first tilt or motion effect and a second motif of an emboss structure having a second tilt or motion effect. Furthermore, an optical security feature is supplied by the second motif in the form of emboss structures, which likewise increases the anti-forgery security of the value and security document because for a forger or imitator the emboss structures are analyzable only with higher technical effort and are hence imitable only with difficulty.

According to a preferred embodiment, a greater context arises from a meaningful linkage of two individual effects, namely the effect pigments and the emboss elements, which puts both individual effects in a relation to each other which is better to capture and therefore easier to authenticate. The interaction of both individual effects is formed by a meaningfulness which is possible only because of their particular combination and therefore offers an additional authentication possibility.

An object as intended by this invention is, for example, a letter or text, a numeral or number, a motif, a portrait, a combination of the above-mentioned objects or any geometrical form or graphic figure, such as an oval, a star or a wheel.

As intended by this invention, the at least partial adapting of an image to another image or of the pattern, sign or coding of the first motif to the pattern, sign or coding of the second motif for example, means that

- a relation exists between both images, patterns or signs, resulting upon tilting the value and security document for example in a change in both images, from a graphic figure, for example a star, to a denomination number, for example the number 50,
- both images or patterns represent respectively a partial image of a total image and the total image results from the interaction of both partial images, for example one image represents the first part of a numeral or a text and the other image the remaining part of the numeral or the text, or
- both images or patterns show the identical motif or the identical appearance
- an image shows a name or a designation and the other image the corresponding portrait or the corresponding figure to this name or this designation; for example, one image shows the designation "bird" as a text and the other image shows the graphic representation of a bird, or one image shows the name of a person and the other image the portrait of this person.

In this connection, 'at least partially' means that at least partial areas of one image, pattern or motif are adapted to partial areas of the second image, pattern or motif and the remaining partial areas can show no or another dynamic motion effect. Here, the total area of one image, pattern or motif is preferably adapted to a partial area or the total area of the other image, pattern or motif.

According to the invention, a logical relation between both motifs must therefore result for a viewer which goes beyond a mere sequence or juxtaposition of individual motifs.

According to the invention, the first and second motif have indeed a similar yet not exactly identical appearance, which is due to the characteristic features of the associated, preferably different manufacturing methods. Thus, for example, a second motif can be realized through a foil element (e.g. the emboss structures in a thermoplastic or radiation-curing lacquer which are subsequently metallized) which shines distinctly stronger than a first motif, which is realized by intaglio blind embossing in a screen printing ink. Simultaneously, e.g. the region with intaglio blind embossing can be tactile, i.e. palpable with the fingers and be e.g. perceptibly rough or ribbed, while the second motif realized by a foil element has a smooth surface without perceptible relief. A viewer therefore connects the two motifs and sees similar optical effects while simultaneously also noting different properties however. A forger must hence be able to forge these different properties as well and will thus, as a rule, have to be proficient in two different manufacturing methods for the first and second motif, which distinctly impedes the fabrication of a hardly distinguishable forgery.

According to the invention, the second motif is applied to the same side of the substrate which the first motif is located on. Here, the first one and the second motif can be arranged directly or immediately on the surface of the substrate. Alternatively, the second motif can also be arranged indirectly or non immediately on the surface of the substrate, wherein in this case the second motif is arranged on a further substrate. The further substrate, on which the second motif is arranged, is arranged directly on the substrate or at least partially within the substrate of the value and security document. According to a further preferred embodiment it is here provided that the second motif is arranged in the form of an emboss structure on a safety thread or security strip which is applied on the substrate or is incorporated at least partially into the substrate. Here, there is preferred as the safety thread a so-called window thread or pendulum thread which is embedded into the substrate and is at certain places of the substrate guided to the surface of the substrate, wherein the first motif and the second motif are arranged in register to each other.

The ink layer is executed preferably translucent and is arranged in at least one partial region above the safety thread or security strip.

According to a preferred embodiment, it is provided that a first motif reflects two or more different picture motifs in different spatial areas so that upon corresponding motion of the value and security document a first tilt or motion image is generated for a viewer. Additionally, the second motif also creates the impression of a second tilt or motion image. The first tilt or motion image is now adapted at least partially to the second tilt or motion image, or the second tilt or motion image at least partially to the first tilt or motion image.

There thus result two tilt or motion images whose appearance is adapted to each other at least partially. For example, upon tilting the value and security document, the first tilt or motion image shows a rotating object. Upon tilting the value and security document, the second motif likewise conveys the impression of a rotation which takes up or continues the rotation of the object of the first motif. Particularly preferably, the second motif is arranged around the first motif and both motifs rotate in identical direction so that the impression of a single rotating object results for the viewer. In another advantageous execution, the rotational motions can also be opposite, which leads to a very dynamically appearing motion.

'Translucency' within the meaning of this invention signifies that an object such as the substrate or the ink layer allows a certain proportion of impinging light to pass through. When light impinges on one side of the object, a certain share of the light is passed through to the other side of the object and exits there. The greater the percentage of passing light in relation to the impinging light is, the more translucent the object is. If the percentage share is at least 90%, i.e. the object passes the impinging light nearly unattenuated therethrough like a window, the object is designated as transparent. However, an object passing about 0% of the impinging light therethrough, i.e. in which the share of light passing therethrough relative to the impinging light is low or near or equal to zero, is designated as opaque or as non-light-transmissive or nontranslucent.

According to a further preferred embodiment, it is provided that a laser inscription is incorporated into at least one side of the substrate such that the laser inscription overlaps the first motif as well as the second motif at least partially.

The substrate according to the invention can be executed as a single-layer or multi-layer safety paper. Multi-layer safety paper contains at least one layer of paper. The further layers can likewise be formed of paper, but also of other materials, for example by plastic foils. Particularly preferably, the safety paper consists of cotton fibers as are employed, for example in bank notes.

Preferably, the substrate can also consist of paper from other natural fibers, likewise preferably from synthetic fibers, i.e. from a mixture of natural and synthetic fibers or likewise preferably of at least one plastic foil. Further preferably, the substrate consists of a combination of at least two different substrates arranged one above the other and interconnected, so-called hybrid, for example a combination of plastic foil/paper/plastic foil, i.e. a substrate of paper is covered on each of its two sides by a plastic foil, or paper/plastic foil/paper, i.e. a substrate of a plastic foil is covered on each of its two sides by a substrate of paper.

Particulars about the weight of the employed substrate are stated, for example, in the script DE 102 43 653 A9 whose executions in this regard are received to the full extent in this application. The script DE 102 43 653 A9 states in particular that the paper layer usually has a weight of 50 g/m$^2$ to 100 g/m$^2$, preferably from 80 g/m$^2$ to 90 g/m$^2$. Any suitable weight can, of course, be used depending on the application.

Security elements or value documents for which such a substrate or security paper can be used are in particular bank notes, shares, bonds, deeds, vouchers, checks, high-quality admission tickets, but also other papers at risk of forgery, such as passports and other identification documents, as well as cards, for example credit or debit cards whose card body has at least one layer of security paper, and also product protection elements, such as labels, seals, packages and the like.

The simplified designation safety paper or value document includes all above-mentioned materials, documents and product authentication means.

According to a further preferred embodiment there is provided that the ink layer consists of at least one effect ink. In particular, the effect inks are background, flexo or screen printing inks, in particular screen printing inks with high reflectivity and a relatively small pigment size. For example UV-curing screen printing inks (silver, gold, bronze) have this property. A chromaticity can be attained by overprinting with glazing colors. A multicoloredness is, of course, also representable in this manner.

Also suitable are color-shift inks of interference-layer pigments, inks on the basis of pearl luster pigments or liquid-crystal pigments. Because bank-note paper has a rough surface, it is advantageous, however, to print color-shift ink either onto smooth surfaces of plastic substrates or multi-layer substrates whose outwardly located layer consists of a plastic layer, or to arrange an (invisible or visible) primer under the ink layer. This primer can be applied either as a background, screen or flexographic print and smooths the rough surface of the substrate. The pigments applied in the screen printing thereby experience a better alignment. Moreover, due to the UV-curing binder systems, the color film is smoother and has a higher reflectivity.

Printing inks which contain magnetically alignable effect pigments are expressly excluded by the scope of protection of this invention because they are cost-intensive in the acquisition and in the processing. An alignment of directed reflecting effect pigments is provided rather preferably by embossing, for example by means of intaglio blind embossing.

It could be proved that a higher reflectivity of the starting material effectuates a better optical effect of the embossing. However, a primer under the screen printed layer also improves the effect, because the gloss of the optically active ink area is increased. The measured gloss values are combined into the following table by way of example:

| Screen printing ink 1 | Screen printing ink 2 | Gloss value |
|---|---|---|
| GD Silver 4410 | | 224.2 |
| — | OASIS Green/blue 5 DC 0000 + 17% of LC 528 | 31.1 |
| Primer SICPA 5 DC 0000 | OASIS Green/blue 5 DC 0000 + 17% of LC 528 | 35.6 |
| OASIS Green/blue 5 DCs 0000 + 17% of LC 528 | Primer SICPA 5 DC 0000 | 48.1 |
| — | OASIS Green/Cu 5 DC 0000 + 23% of LC 636 | 18.5 |
| Primer SICPA 5 DC 0000 | OASIS Green/Cu 5 DC 0000 + 23% of LC 636 | 34.3 |
| OASIS Green/Cu 5 DC 0000 + 23% of LC 636 | Primer SICPA 5 DC 0000 | 40.9 |
| Primer SICPA 5 DC 0000 | OVI Magenta/green 9Z3D50 | 27.0 |
| OVI Magenta/green 9Z3D50 | Primer SICPA 5 DC 0000 | 38.0 |
| GD Silver 4410 | Blue GSI 680821 | 65 |
| GD Silver 4410 | Yellow GSI 680102 | 55 |

Here, the screen printing ink 1 is the lower screen printed layer or the primer and the screen printing ink 2 is the upper screen printed layer, if the printing was done on a primer.

The gloss values were measured with a gloss meter "micro gloss" by the BYK-Gardner company at an angle of 60° relative to the vertical. The measuring results of the gloss meter are here not relative to the irradiated light quantity, but to a black, polished glass standard with the defined refractive index of 1.567. For this standard, the measurement value is set to 100 gloss units.

While the UV silver color GD Silver 4410 by itself shows a very high reflectivity, selectively reflective color systems have distinctly lower gloss values (from 15 to 30 gloss units) which can be increased to 35 to 50 gloss units by combination with a primer. Indeed, an overprinting of the UV silver ink GD Silver 4410 with background colors leads to a reduction of the gloss value, however, the effect of the embossing is nevertheless very readily visible.

The size of the effect pigments is also decisive for the quality of the effect, because small pigments can distinctly better follow the structures of the embossing, while greater pigments can break as the case may be. Preferably the size of the effect pigments lies between 1 μm to 50 μm, preferably between 5 μm to 25 μm to enable an embossing of the ink layer which results in a distinctly recognizable change of information or a distinctly more recognizable dynamic motion effect.

Alternatively, the ink layer can also consist of at least one vapor-deposited metal layer or of multi-layer thin-film layer interference layers which are known, for example, from WO 2009/149831 A2.

Recesses within the overprinting increase the design possibilities so that in the plan view so-called "bimetallic" impressions (silver/gold) can also be implemented. Here, a golden color tone is generated by a yellow overprinting on a silver background. When the yellow overprinting is left blank in partial regions, an alternately gold-colored and silver-colored and therefore "bimetallic" area results.

The invention relates further to a method for producing a value and security document according to the invention, wherein the ink layer is imprinted onto the substrate with effect pigments. Here, all printing methods known from the prior art can be applied, particularly preferably the screen printing process or also the flexographic printing process. In the flexographic printing process, particularly preferably an ink layer with high layer thickness is applied to the substrate, for example with the help of a screen roll an inking having a weight per unit area of 20 g/m$^2$.

The emboss structures are manufactured preferably with an emboss plate or an embossing cylinder, particularly preferably an intaglio printing plate or an intaglio printing cylinder, into which the emboss structures are incorporated, for example by means of lasering. The dimensions of the emboss structures are laterally more than 30 μm, preferably more than 30 μm to 2000 μm, particularly preferably more than 30 μm to 300 μm and very particularly preferably more than 30 μm to 150 μm, and vertically more than 10 μm, preferably more than 10 μm to 150 μm, particularly preferably more than 10 μm to 100 μm and very particularly preferably more than 10 μm to 60 μm.

Such emboss structures are known, for example, from WO 2013/045055 A1.

It will be appreciated that the features mentioned hereinabove and those to be explained hereinafter are usable not only in the stated combinations but also in other combinations without going beyond the scope of the present invention, provided this is covered by the scope of protection of the claims.

The advantages of the invention will be explained with reference to the following exemplary embodiments and the complementary drawings. The embodiment examples represent preferred embodiments, without the invention being in any way limited thereto. Furthermore, the representations in the drawings are strongly schematic for the sake of better comprehension and do not reflect the actual conditions. In particular, the proportions shown in the drawings do not correspond to the relations existing in reality and serve exclusively to improve the clearness. Furthermore, the embodiments described in the following embodiment examples are reduced to the essential core information for the sake of easier comprehension. In the practical implementation, substantially more complex patterns or images can be used.

BRIEF DESCRIPTION OF THE DRAWINGS

Specifically, there is schematically shown a detail of a value and security document according to the invention.

DETAILED DESCRIPTION OF VARIOUS EMBODIMENTS

Figure 1:
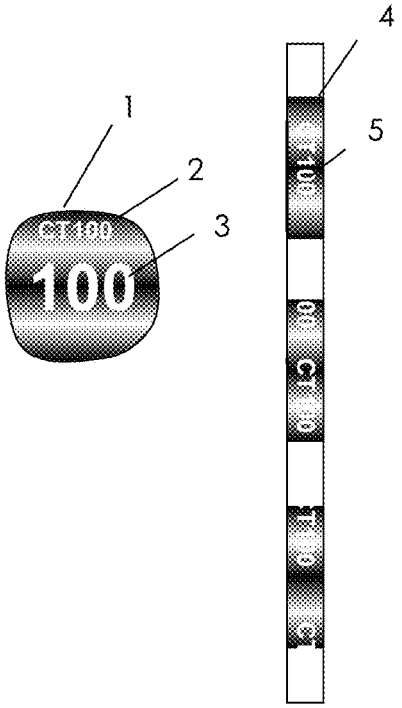
FIG. 1 having a first motif on a safety thread and a second motif in the form of an oval imprint in a first embodiment, FIG. 2 having a first motif on a safety thread and a second motif in the form of an oval imprint in a second embodiment, FIG. 3 having a first motif on a safety thread and a second motif from an imprint in the form of a numeral, FIG. 4 having a first motif on a safety thread and a second motif from an imprint in the form of a section of a numeral, FIGS. 5*a* and 5*b* having a first motif in the form of a strip-shaped, optically variable imprint and a second motif arranged thereabove which upon tilting shows the same change in motif.

FIG. 1 shows an oval imprint 1 which is imprinted on one side of a substrate of a bank note. The imprint 1 here consists of individual emboss structures not visible to a viewer, which show a second motif having a dynamic motion effect in the form of moving lines. Within the imprint 1, there are recesses 2 in the form of the text "CT100" and recesses 3 in the form of the number "100".

On the right next to the imprint 1, a safety thread 4 is located which is incorporated into the substrate of the bank note in the form of a windowed thread. Here, three regions of the windowed thread are arranged on the surface of the bank note and two regions lying between these regions of the pendulum thread in the interior of the substrate of the bank note and are therefore non visible. On the safety thread 4 there is located a first motif 5 which, just like the imprint, shows a motion effect having moving lines, wherein this motion effect is generated by an effect ink. In the effect ink, there are recesses 5 in the form of the text "CT100".

The numeral "100" here represents the denomination number of the bank note which is located therefore on the safety thread 4 as well as in the imprint 1. Thereby a viewer can recognize a logical relation between the motifs of the safety thread 4 and the imprint 1. Further, the viewer perceives that both motifs have the same or at least a very similar motion effect.

Figure 2:
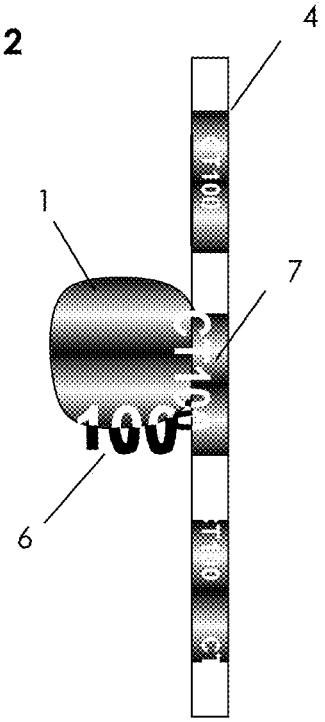

FIG. 2 shows a similar embodiment example as FIG. 1, wherein here the oval imprint 1 is imprinted on the surface of the bank note such that it slightly overlaps the safety thread 4. Furthermore, recesses 6 in the form of the number "100" are so arranged in the imprint 1 that they apparently project about the edge of the imprint 1 and are continued or complemented beyond the imprint 1 as an imprint with black ink. Additionally, recesses 7 in the form of a part of the text "CT100" are also arranged on the safety thread 4 such that they, with recesses in the imprint to 1 and a black imprint on the bank note, complement to the total text "CT100".

Figure 3:
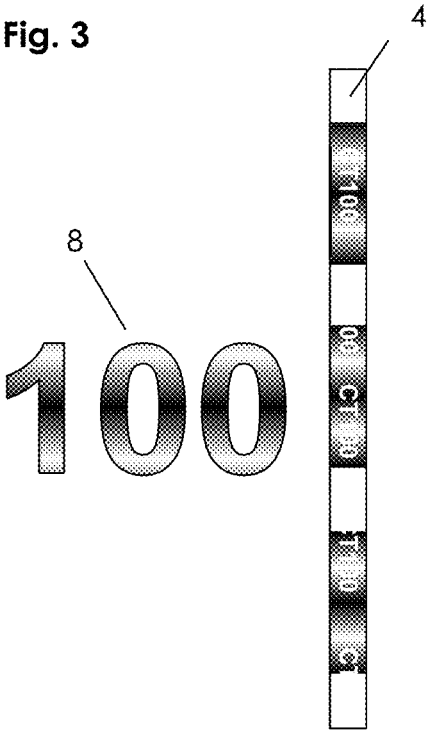

FIG. 3 shows an imprint 8 in the form of the numeral "100". The outline form of the imprint 8 therefore corresponds with the recesses on the safety thread 4.

Figure 4:
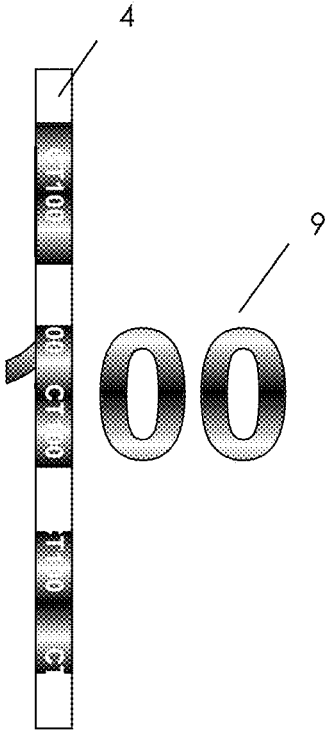

For the embodiment of FIG. 4, the center region of the safety thread 4 forms a part of the numeral "1" of the imprint 9. This region of the safety thread and the imprint 9 therefore complement to the numeral "100". An additional relation therefore results for a viewer between the safety thread 4 and the imprint 1.

Figure 5A:
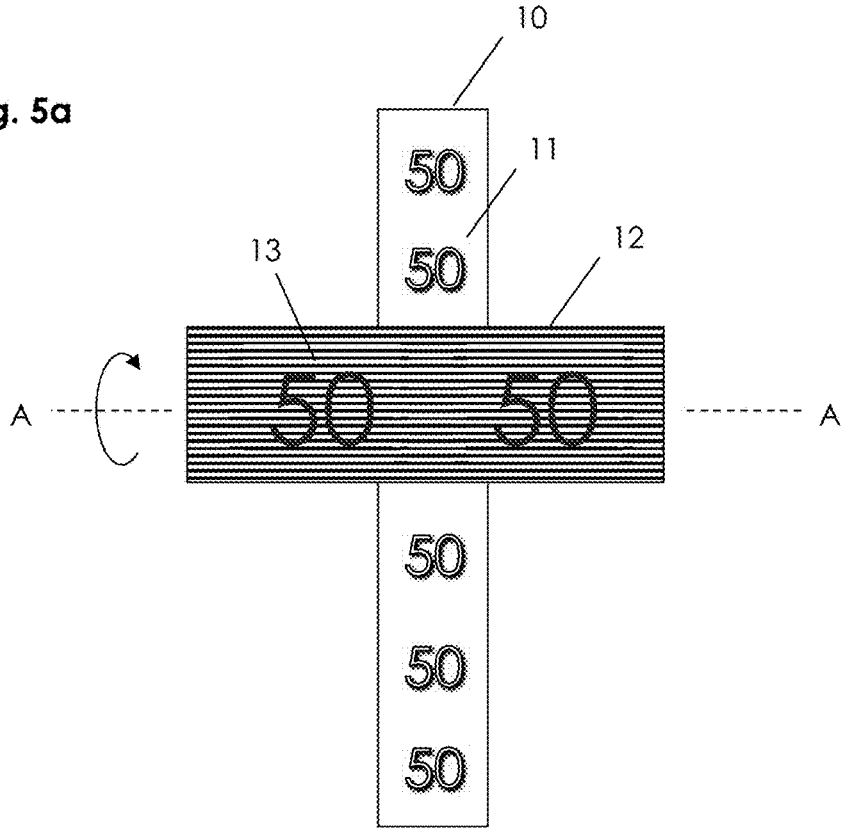
Figure 5B:
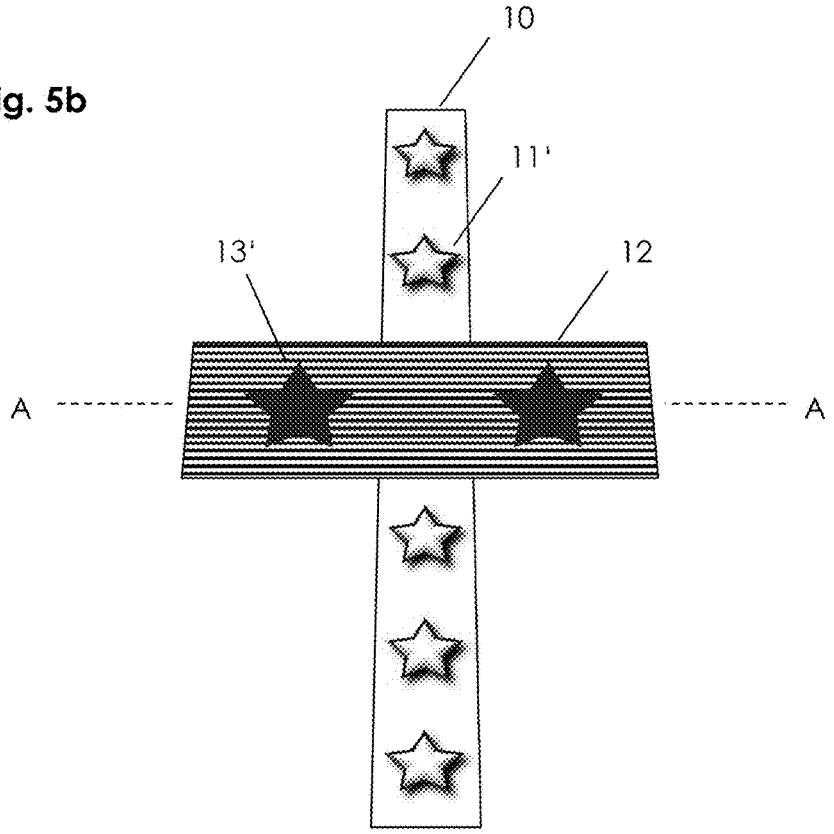

FIG. 5 shows in FIG. 5*a* in perpendicular plan view a detail of a side of a bank note having a strip-shaped security strip 10 and an optically variable imprint 12.

The optically variable imprint 12 consists of an ink layer of an effect ink which in some regions shows the first motif 11 in the form of the numeral "50" which upon tilting changes into a 5-pointed star. The emboss structure 12 consists of parallel arranged emboss elements as they are known, for example from WO 2013/045055 A1, and in some regions shows the first motif 13.

The security strip 10 likewise shows a tilt effect between the denomination number "50" and a 5-pointed star which forms the second motif here. In an particularly advantageous variant the "50" and the star can also appear bulged, which is particularly amazing and memorable for a smooth-feeling security strip, e.g. on foil basis. The realization of such tilt images with bulge effect is known, for example, from that WO 2014/060089 A2.

Upon tilting the bank note around the axis AA backwards in the direction of the arrow, the representation of both motifs thus changes respectively from the numeral "50" to a 5-pointed star which additionally appears in the security strip 10 three-dimensionally and apparently bulges from the surface. Upon tilting the bank note around the axis AA, both motifs therefore show a tilt effect of the same kind.

In a further variant the motifs can also tilt exactly opposite. Thus, in the stated example, the security strips 10 could show the star at the first tilting angle and the imprint 12 at the same tilting angle the "50", while at the second tilting angle the security strip 10 then shows the "50" and the imprint the star.

The invention claimed is:

1. A value and security document which comprising of a substrate having a front side and a back side, wherein on the front side or back side of the substrate an ink layer is applied into which a first motif is incorporated in the form of a pattern, sign or coding, wherein the first motif is configured in the form of an emboss structure including a plurality of raised emboss elements having areas of different orientation which are characterized by the parameters size, outline form, relief form, reflectivity and spatial alignment, and which upon tilting the value and security document shows a first tilt or motion effect by at least two different groups of emboss elements having different characteristic parameters reflecting incident light in different spatial areas, and the emboss elements having respectively a lateral dimension of more than 30 μm and a height of more than 10 μm, wherein the first motif is combined with a second motif in the form of a pattern, symbol or coding, wherein the second motif is arranged on the same side of the substrate as the first motif, wherein the second motif is configured in the form of an emboss structure including of a plurality of raised emboss elements having areas of different orientation which are characterized by the parameters size, outline form, relief form, reflectivity and spatial alignment, and which show the second motif having a second dynamic tilt or motion effect by at least two different groups of emboss elements having different characteristic parameters reflecting incident light in different spatial areas, and in which the emboss elements have respectively a lateral dimension of less than 30 μm and a height of less than 10 μm, wherein the pattern, symbol or coding of the first motif is adapted at least partially to the pattern, symbol or coding of the second motif.

2. The value and security document according to claim 1, wherein a first motif reflects two or more different picture motifs in different spatial areas so that for the viewer upon a corresponding motion of the value and security document a first tilt or motion image arises, and the second motif reflects two or more different picture motifs in different spatial areas so that for the viewer upon a corresponding motion of the value and security document a second tilt or motion image arises, wherein the first tilt or motion image is at least partially adapted to the second tilt or motion image, or the second tilt or motion image is at least partially adapted to the first tilt or motion image.

3. The value and security document according to claim 1, wherein the first motif is arranged on the substrate and the second motif is arranged on a safety thread or security strip which is applied on the substrate or is incorporated at least partially into the substrate.

4. The value and security document according to claim 3, wherein the safety thread is a window or pendulum thread which is embedded into the substrate and at certain places of the substrate is guided to the surface of the substrate, wherein the first motif and the second motif are arranged in register to each other.

5. The value and security document according to claim 3, wherein the ink layer is executed translucent and is arranged in at least one partial region above the safety thread or security strip.

6. The value and security document according to claim 1, wherein the ink layer comprises at least one effect ink.

7. The value and security document according to claim 1, wherein a laser inscription is incorporated into at least one side of the substrate such that the laser inscription overlaps the first motif as well as the second motif at least partially.

8. The value and security document according to claim 1, wherein the first motif and the second motif in their interaction form the common third motif.

9. A method for manufacturing a value and security document which is formed by a substrate having a front side and a back side, wherein on the front side or back side of the substrate an ink layer is applied which forms a first motif in the form of a pattern, sign or coding, wherein the first motif is configured in the form of an emboss structure comprising a plurality of raised emboss elements having areas of different orientation which are characterized by the parameters size, outline form, relief form, reflectivity and spatial alignment, and which upon tilting the value and security document shows a first tilt or motion effect by at least two different groups of emboss elements, having different characteristic parameters, reflecting incident light in different spatial areas, and the emboss elements having respectively a lateral dimension of more than 30 μm and a height of more than 10 μm, wherein the first motif is combined with a second motif in the form of a pattern, symbol or coding, and wherein the second motif is applied to the same side of the substrate as the first motif, wherein the second motif is configured in the form of an emboss structure which is formed by a plurality of raised emboss elements having areas of different orientation which are characterized by the parameters size, outline form, relief form, reflectivity and spatial alignment, and which form the second motif having a second tilt or motion effect by at least two different groups of emboss elements, having different characteristic parameters, reflecting incident light in different spatial areas, and in which the emboss elements have respectively a lateral dimension of less than 30 μm and a height of less than 10 μm, wherein the pattern, symbol or coding of the first motif is adapted at least partially to the pattern, symbol or coding of the second motif.

10. The method according to claim 9, wherein the ink layer is imprinted on the substrate with a screen printing process or a flexographic printing process.

11. The method according to claim 10, wherein the ink layer comprises an effect ink.

12. The method according to claim 10, wherein the ink layer is embossed by an intaglio blind embossing.

* * * * *